US006155528A

United States Patent [19]

Collura

[11] Patent Number: 6,155,528

[45] Date of Patent: Dec. 5, 2000

[54] RECYCLED TIRE SUPPORTING FRAME MEMBER

[76] Inventor: Frank Collura, 2926 W. Jean St., Tampa, Fla. 33614

[21] Appl. No.: 09/325,785

[22] Filed: Jun. 4, 1999

[51] Int. Cl.[7] ..... A47G 1/06; A47G 1/18

[52] U.S. Cl. ..... 248/466; 40/725

[58] Field of Search ..... 248/475.1, 489, 248/466; 40/725, 757, 768

[56] References Cited

U.S. PATENT DOCUMENTS

| | | | |
|---|---|---|---|
| 4,162,056 | 7/1979 | Moorhead | 248/495 |
| 4,450,636 | 5/1984 | Lasurdo | 40/152 |
| 5,637,057 | 6/1997 | Collura | 482/27 |

OTHER PUBLICATIONS

The Old Tire, Suzanne Hayes, Apr. 19, 1993, St. Petersburg Times, p. 3

Hints from Heloise, Dec. 16, 1991, The Houston Chronicle, p. 2

Brains of Britain; Millenium Products showing creativity of UK industries, Apr. 9, 1998, Information Access Company

*Primary Examiner*—Ramon O. Ramirez
*Assistant Examiner*—Jon Szumny

[57] ABSTRACT

A recycled tire supporting frame member for supporting and mounting a plurality of devices having a substantially round configuration having an outer surface, an inner surface, an outer rim, an inner rim, and a tire bead affixed to the inner rim. At least one anchor affixed to the inner surface of said member, and the round configuration having a substantially round opening at the center. A multiplicity of devices is affixed to the central opening such as a clock, a mirror, a picture, a bubble chamber, and others.

5 Claims, 10 Drawing Sheets

RECYCLED TIRE SUPPORTING FRAME MEMBER

BACKGROUND

1. Field of the Invention

Generally, this invention is directed towards recycling used, worn or damaged automobile tires. More specifically, this invention uses the inner side wall of an automobile tire as the supporting frame member for pictures, mirrors, and a plurality of other devices that are discussed below.

2. Description of the Prior Art

Millions of used tires exist in stock piles around the country. The build up of tires is an increasing problem since the tires are bulky in nature and take up large areas of land space. Another problem is that the stock pile of tires are havens for mosquitoes and their larva to breed thereby creating unsafe conditions for the surrounding public areas. In addition, tires do not decay, and thus the problem is not likely do disappear on its own. With increasingly more people buying automobiles, the problem of discarded tires is only going to get larger and lager. To conclude, different systems need to be employed to recycle these used tires at a rate that is at least equal to the amount of tires being discarded to clean and replenish our environment.

There are numerous programs springing up across the country to recycle used automobile tires. One program grinds up the tires into small pieces, whereby these pieces are used as fuel in incinerators. In another program, the tires are ground up into small pieces, the pieces are spread onto the floors of playgrounds whereby the small pieces act as a cushioning medium to prevent injuries.

While some of the prior art may contain some similarities relating to the present invention in their intent, none of them teaches, suggest or include all of the advantages and unique features of a tire picture frame made with the side walls recycled tires. For the foregoing reasons, there is a need to recycle used automobile tires in a way that will allow the used tires to be used for other purposes after their initial intent has expired.

SUMMARY

The present invention is directed towards a recycled tire supporting frame member that is made out of the side walls of used automobile tires. The supporting frame is made from the sidewalls of used tires turned inside out thereby exposing the essentially untouched inner side wall. The essentially new inner side of the tire then becomes the outer side of the supporting frame member. The tendency for the tire's side wall to bow outwards somewhat creates a cavity which further allows for a variety of objects to be inserted into the cavity. This inherent feature greatly increases the flexibility of uses for the tire supporting frame. The tire supporting frame member can then be incorporated in a multiplicity of uses such as a picture frame, a mirror frame, and other devices.

Accordingly, it is a general object of this invention to provide a recycled tire supporting frame member made out of used automobile tires.

Another object of this invention is to provide a recycled tire supporting frame member that will allow a multiplicity of objects to be incorporated into its structure.

Still, another object of this invention is to use the inner surface side wall of a used automobile tire that is essentially in new condition to provide the outer surface and frame for the tire supporting frame member.

Still yet another object of this invention is to utilize the natural tendency of the turned inside out side walls of the tires to bow which creates a chamber or cavity and allows more flexibility for objects of various dimensions to be inserted in the cavity.

Other objects and a fuller understanding of the invention will become apparent from reading the following detailed Description of a preferred embodiment in conjunction with the accompanying drawings.

BRIEF DESCRIPTION OF THE DRAWINGS

This invention, together with other objects, features, aspects and advantages thereof, will be more clearly understood from the following description, considered in, conjunction with the accompanying drawings.

Ten sheets of drawings are furnished, sheet one contains FIG. 1, sheet two contains FIG. 2, sheet three contains FIG. 3, sheet four contains FIG. 4, sheet five contains FIG. 5, sheet six contains FIG. 6, sheet seven contains FIG. 7, sheet eight contains FIG. 8, sheet nine contains FIG. 9, and sheet ten contains FIG. 10.

LIST OF ELEMENTS

1. OUTER SURFACE
2. OUTER RIM
3. OPENING
4. INNER RIM OF TIRE BEAD
5. INNER SURFACE
6. TIRE BEAD
7. OUTER RIM
8. MIRROR SURFACE
9. DECORATIONS
10. ANCHOR
11. PICTURE WIRE
12. BACK OF MIRROR

13. WALL
14. WALL SURFACE
15. TABLE TOP
16. LEG
17. DOOR
18. CLOCK
19. U-HOOK
20. BUBBLE CHAMBER
21. CAR MODEL
22. SHELVES

DESCRIPTION OF THE PREFERRED EMBODIMENTS

Figure 1:
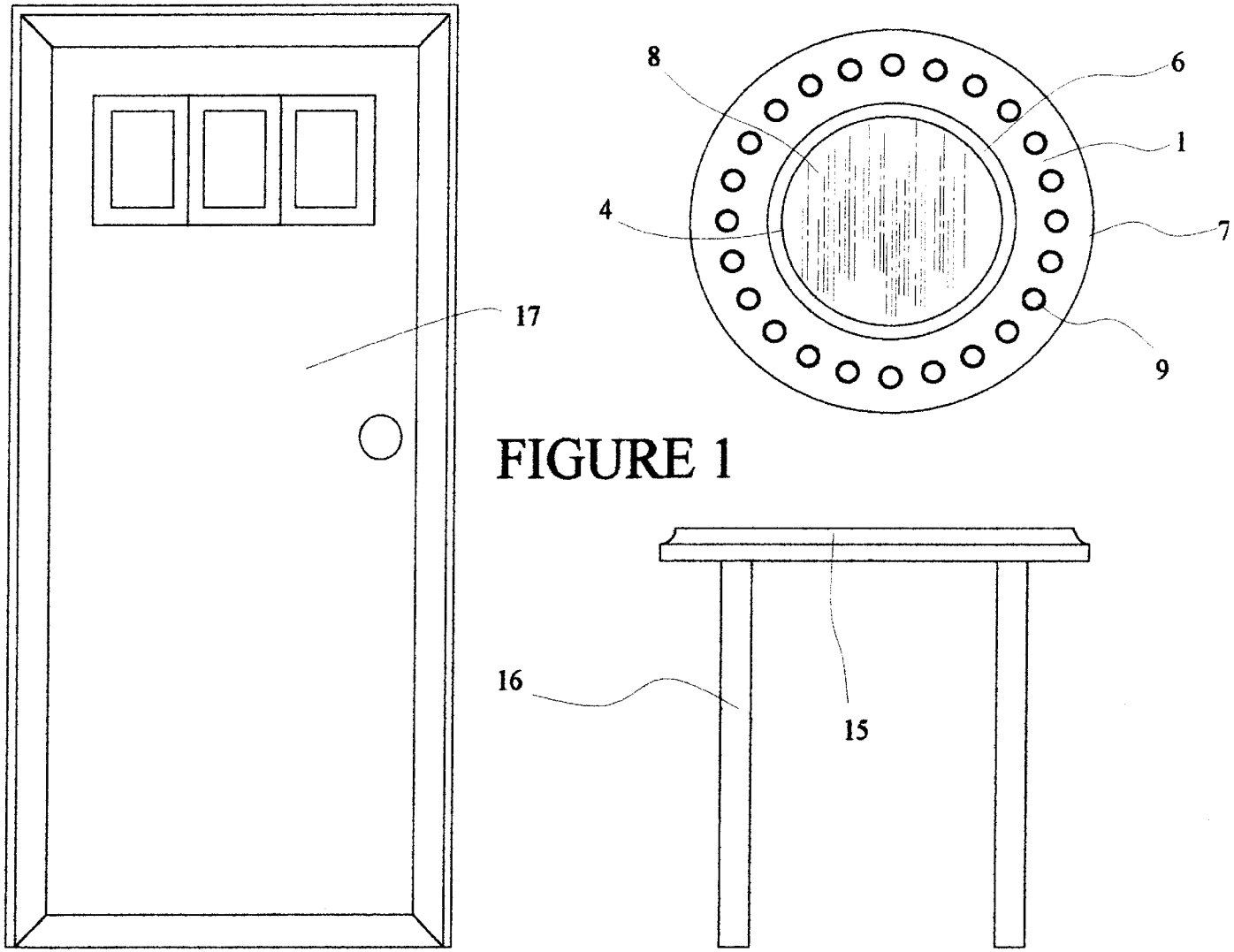
FIG. 1 shows a front view of the recycled tire supporting frame member in the typical environment that it can be used.
Figure 2:
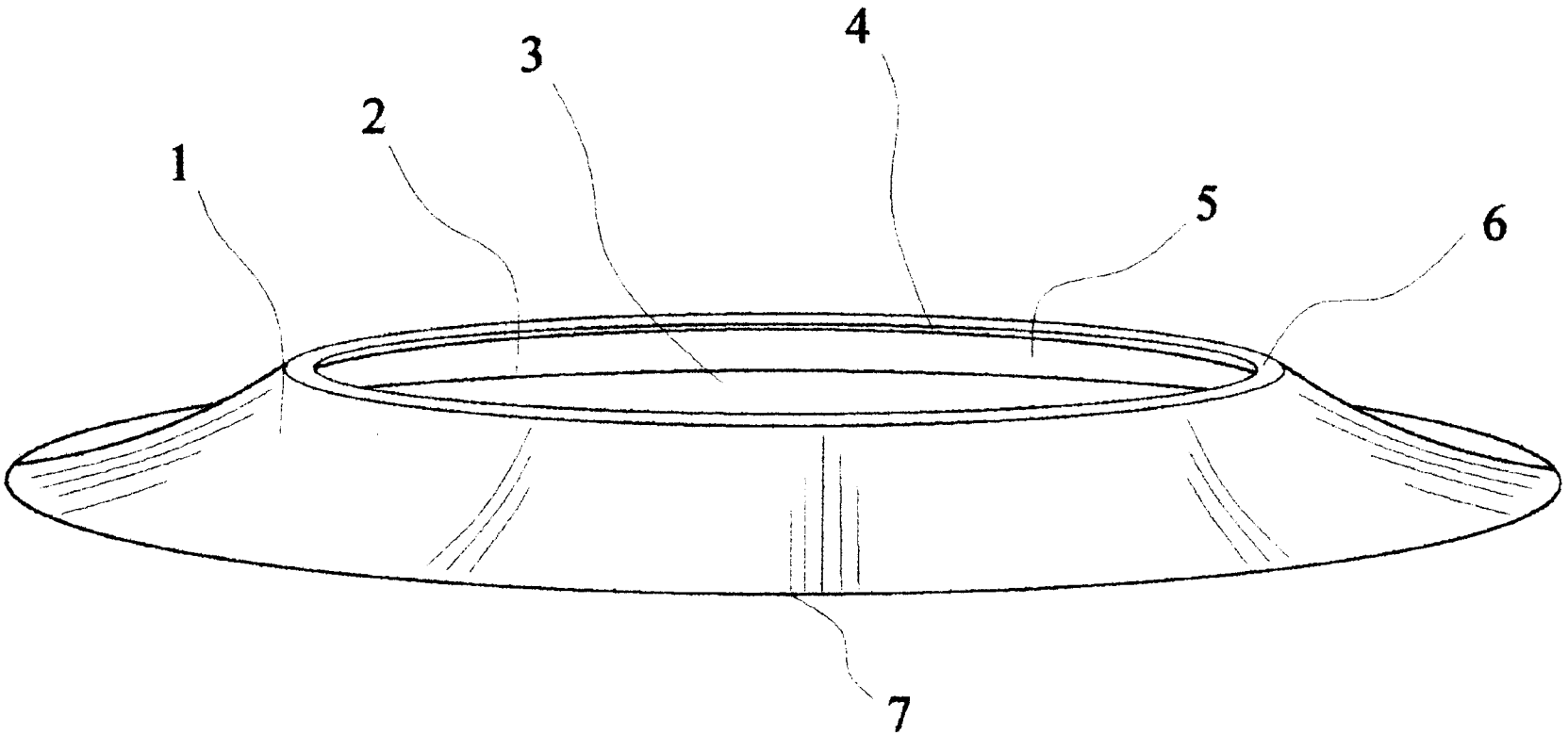
FIG. 2 shows a perspective view of the recycled tire supporting frame member with the front side and opening facing the upward.
Figure 3:
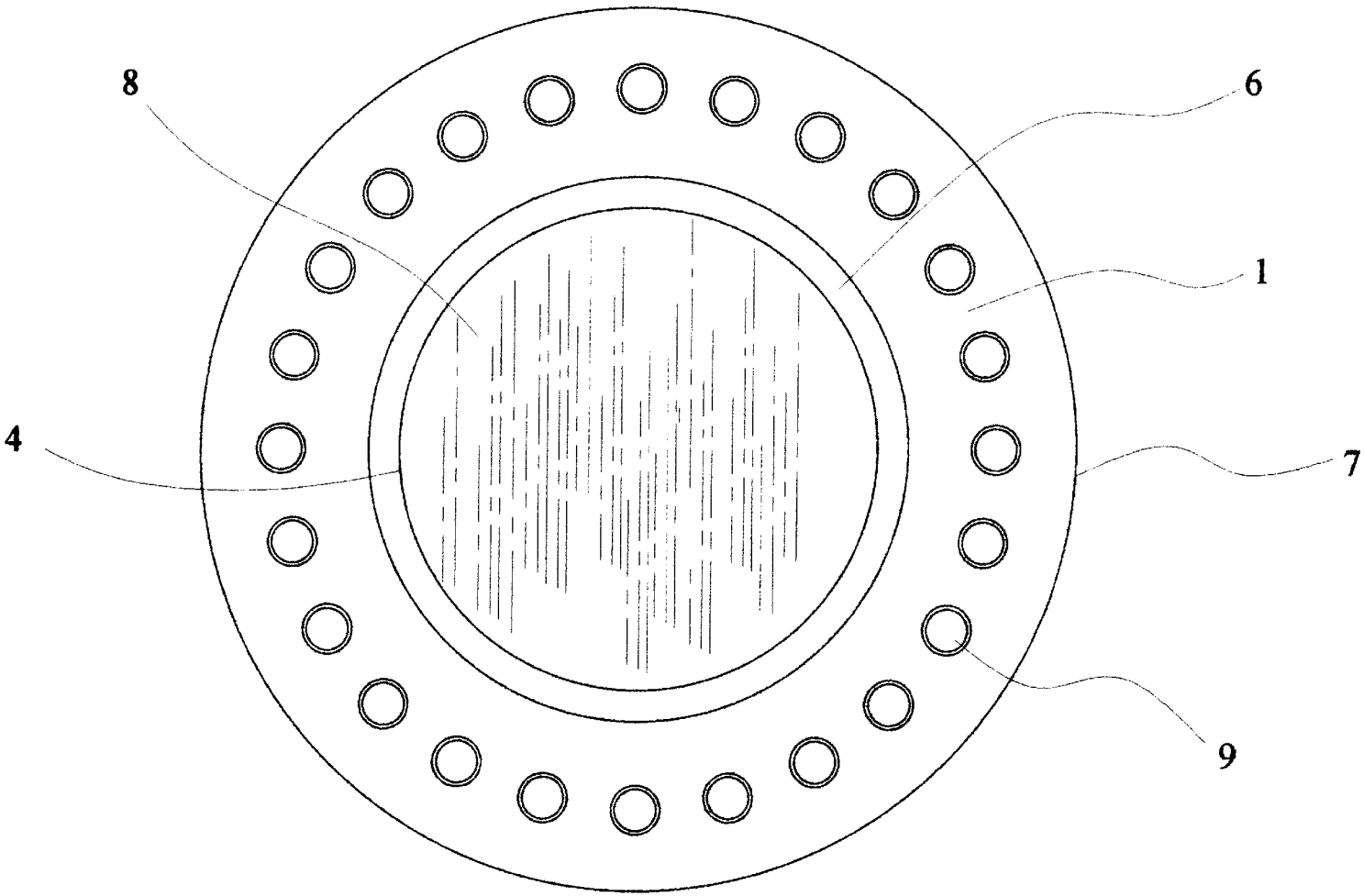
FIG. 3 shows the front side and enlarged view of the recycled tire supporting frame member having a mirror inserted in the opening of the tire.

Referring now to FIGS. 1–10, a recycled tire supporting frame member for mounting and supporting a plurality of ornamental and useful devices to a building wall. In FIG. 1 we see the frame member affixed to a wall as it would be in a typical environment. The member contains generally an outer surface 1, an outer rim 2, a central opening 3, an inner rim 4, an inner surface 5 a tire bead 6 and an outer perimeter 7. A multiplicity of different decorations 9 can be affixed to the outer surface 1. This concept makes the supporting member great for art and crafts enthusiast. In FIGS. 1, 3, 4, and 10, a mirror is inserted and affixed to the opening 3 of the supporting member.

Figure 6:
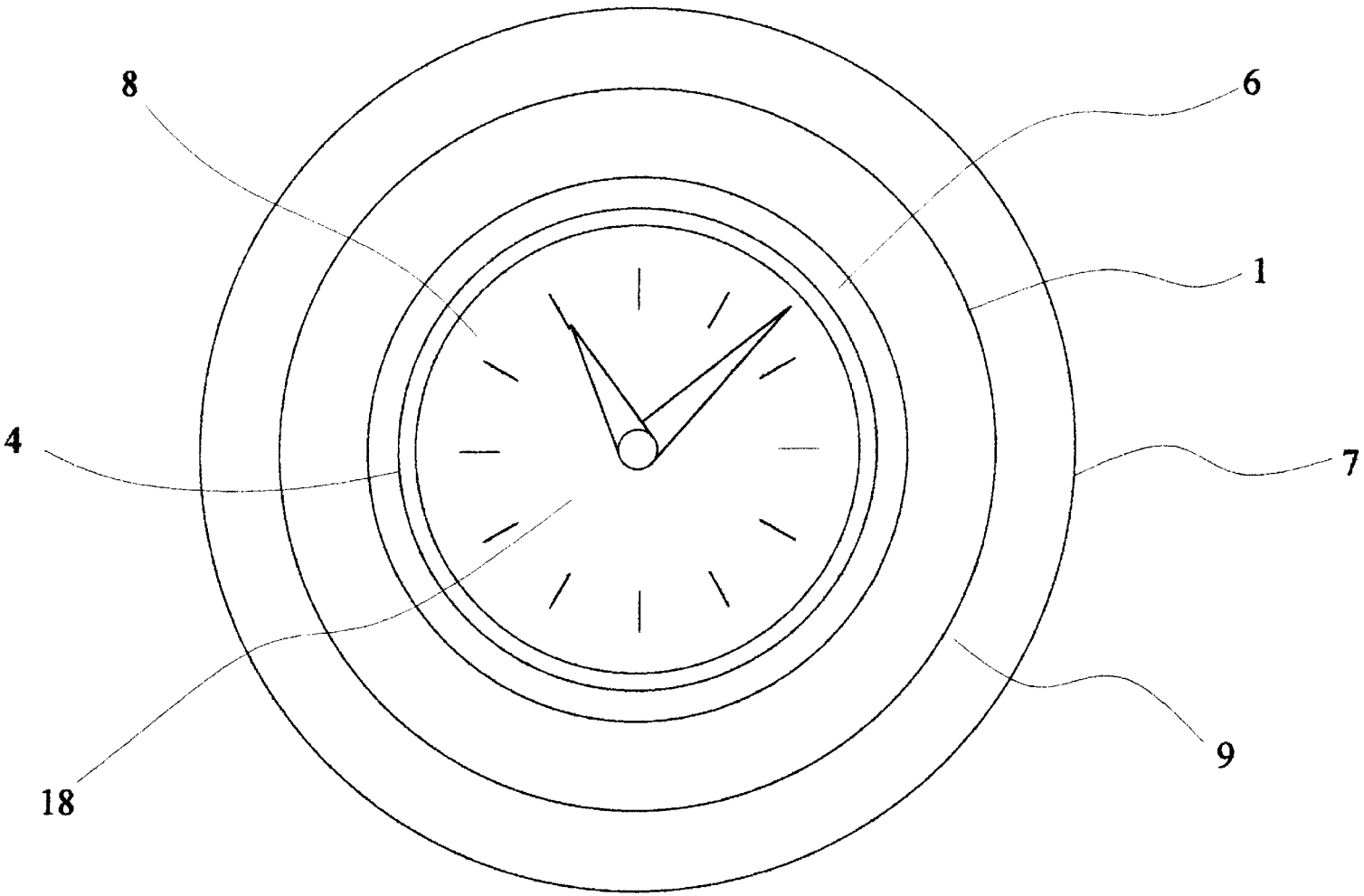
FIG. 6 shows a front view of the recycled tire supporting frame member having a clock mechanism affixed to the opening of the tire.
Figure 7:
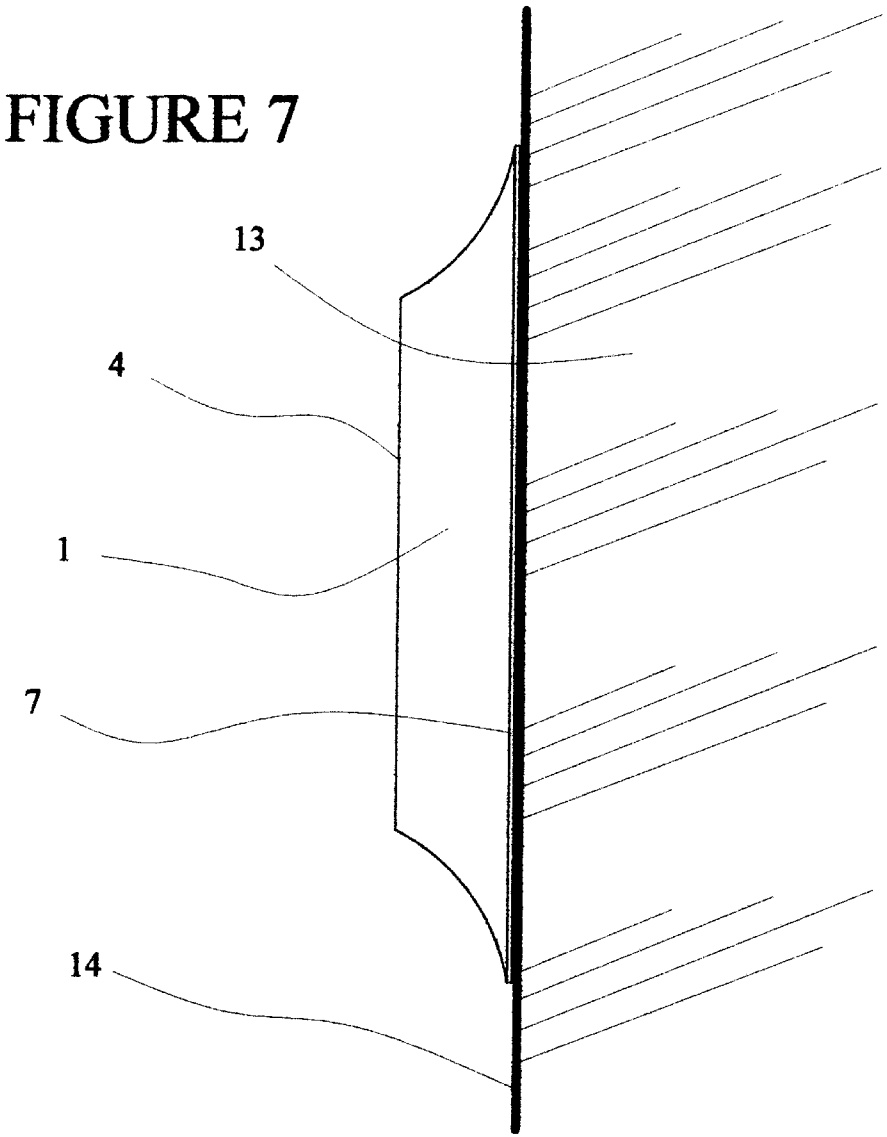
FIG. 7 shows a side view of the recycled tire supporting frame member affixed to the surface of a wall.
Figure 8:
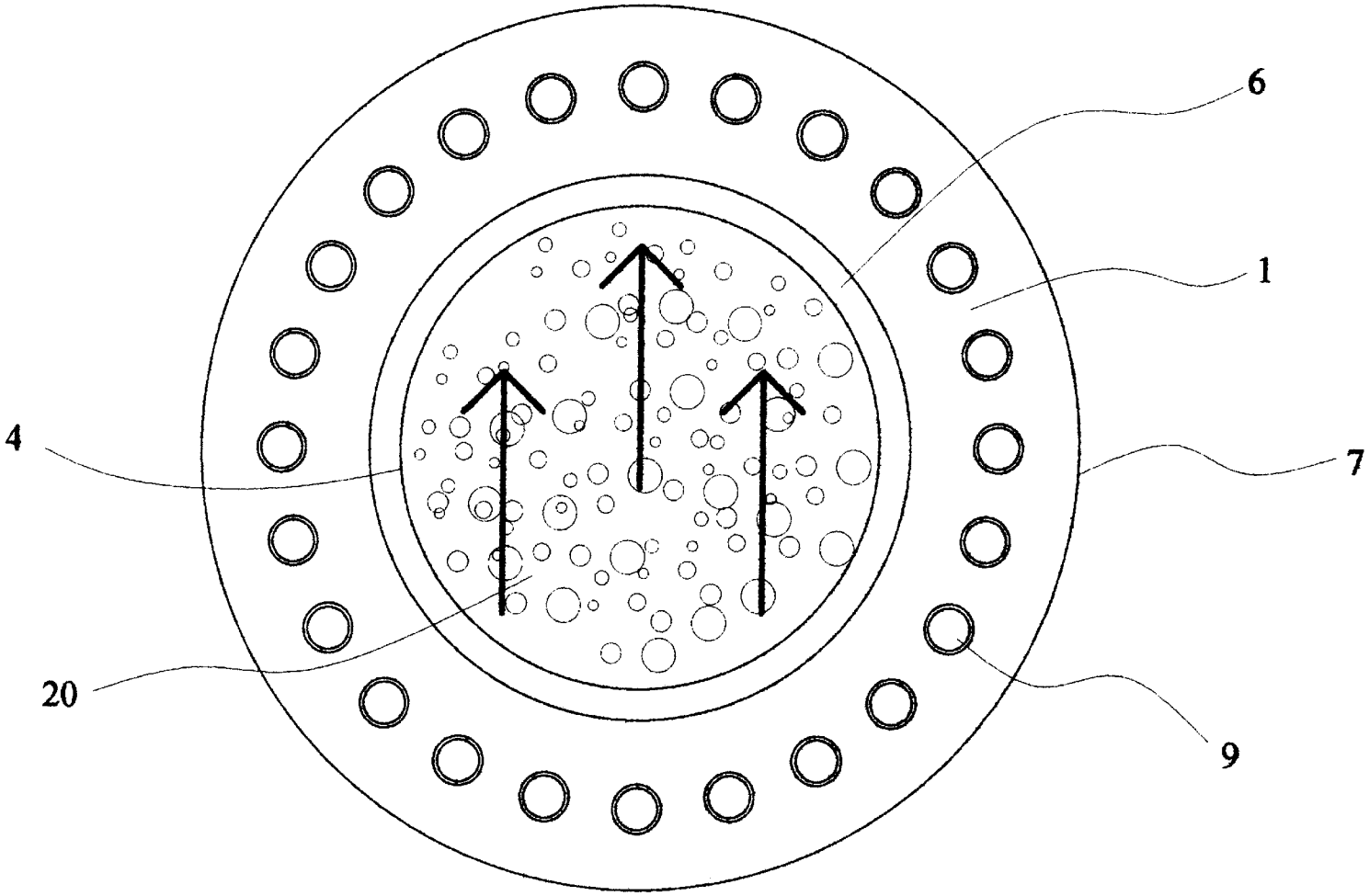
FIG. 8 shows a front view of the recycled tire supporting frame member having a decorative bubble chamber affixed inside the opening.
Figure 10:
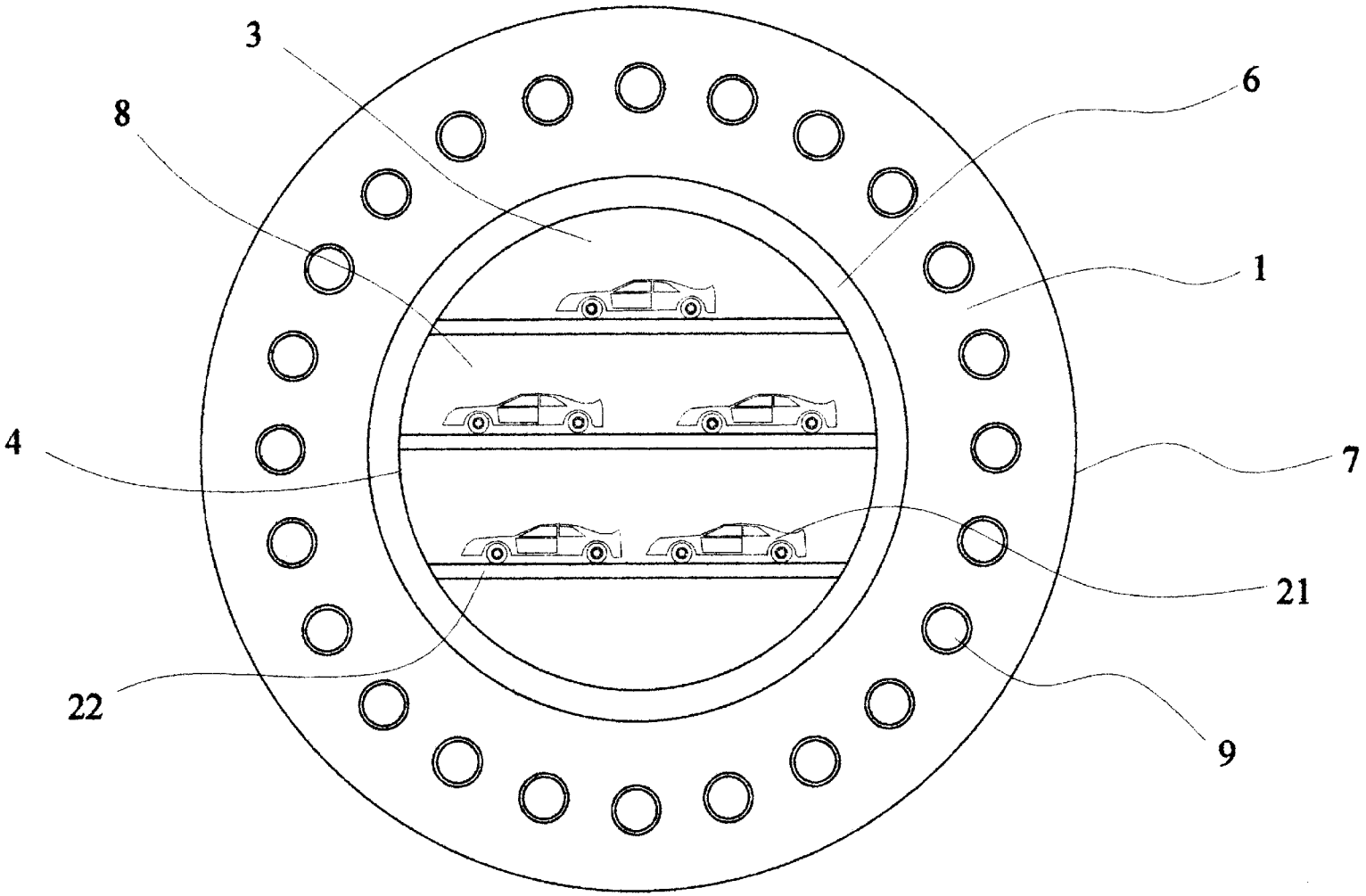
FIG. 10 shows a front view of the recycled tire supporting frame member having multiple shelves inserted in the cavity in a horizontal fashion.

In FIG. 6, a clock replaces the mirror, and in FIGS. 8 and 10, a decorative bubble chamber and shelf system are used. Note, the three dimensional nature of the tire frame member allows for a multiplicity of devices to be inserted into the formed cavity, from pictures and clocks to glass water bubble chamber and ant farms. The only limit is the person's imaginations.

Figure 4:
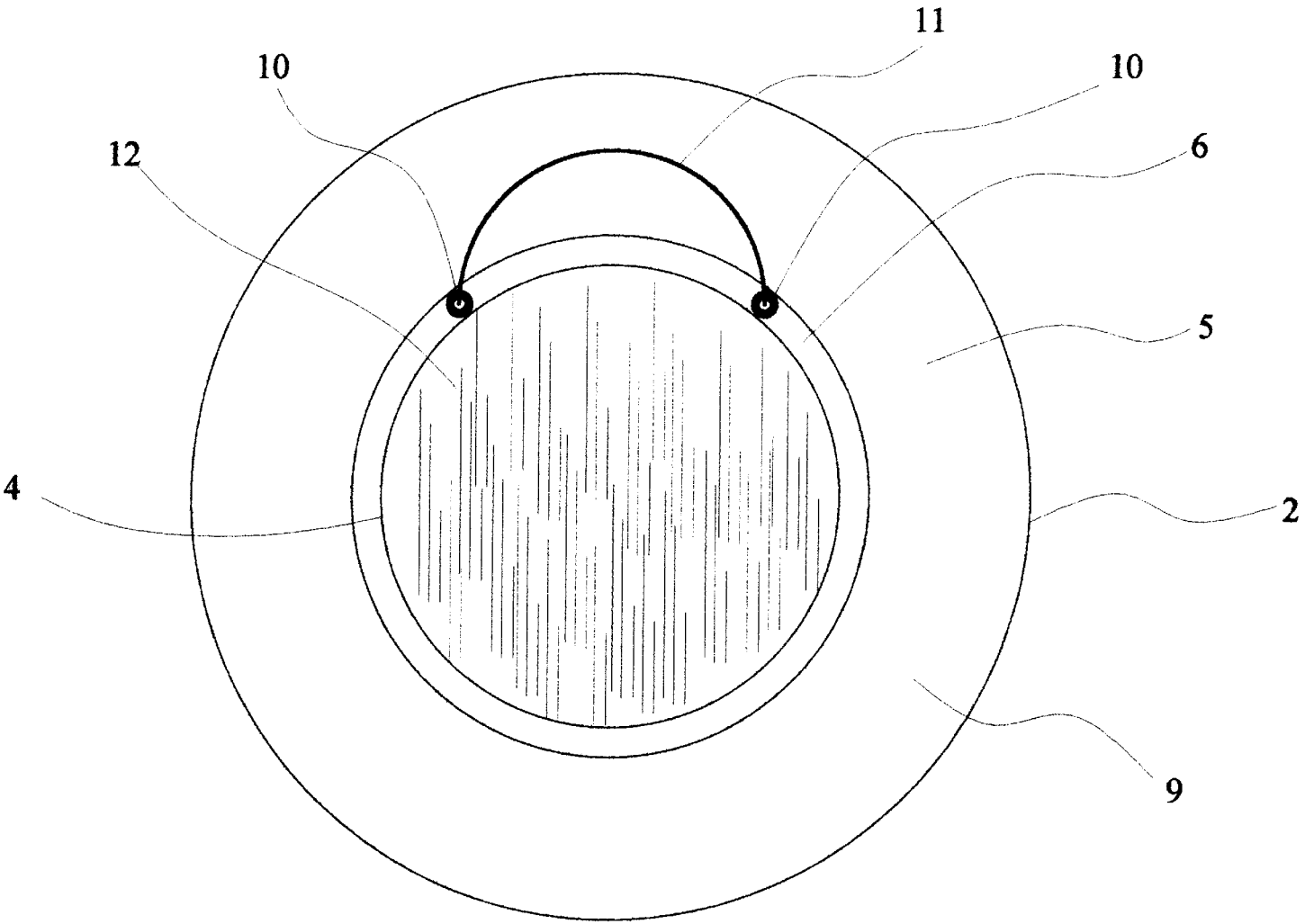
FIG. 4 shows the rear side and enlarged view of the recycled tire supporting frame member. A pair of anchors is shown affixed to the tire bead with a picture wire affixed to both anchors.
Figure 5:
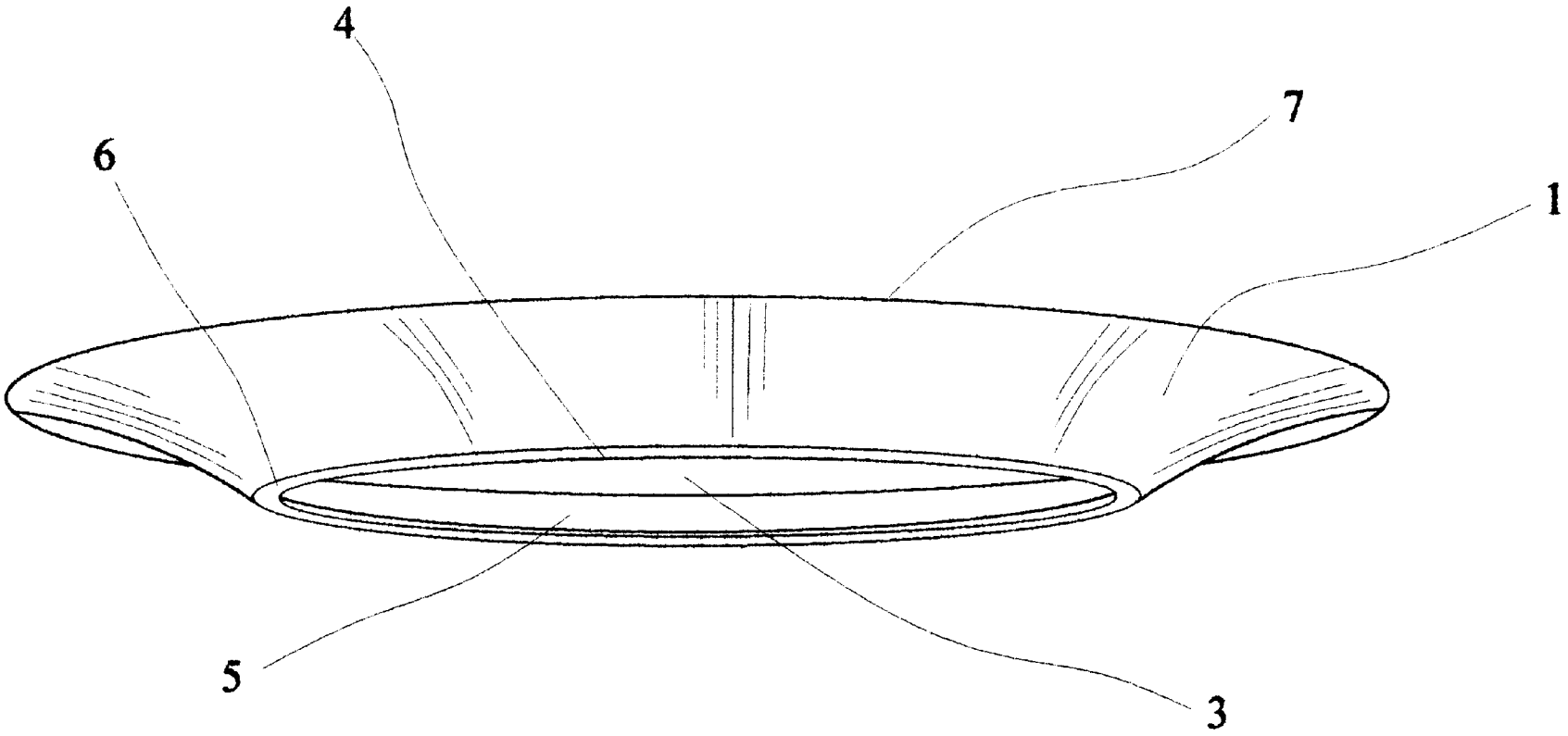
FIG. 5 shows an internal view of a rectangular conduit looking from the inside of the entrance opening down to the exit opening.

FIG. 4 shows how the rear surface of the supporting member is affixed to a wall using conventional picture frame wire 11. A pair of anchors 10 is typically affixed to the tire bead 6 and the wire 11 then joins both the anchors 10. Then a nail is hammered into a wall's surface whereby the picture wire is hung supporting the tire frame member. Note, the anchors 10 are normally screwed into the bead 6 for extra support, because the screw can be affixed without penetrating the front surface of the supporting member.

Figure 9:
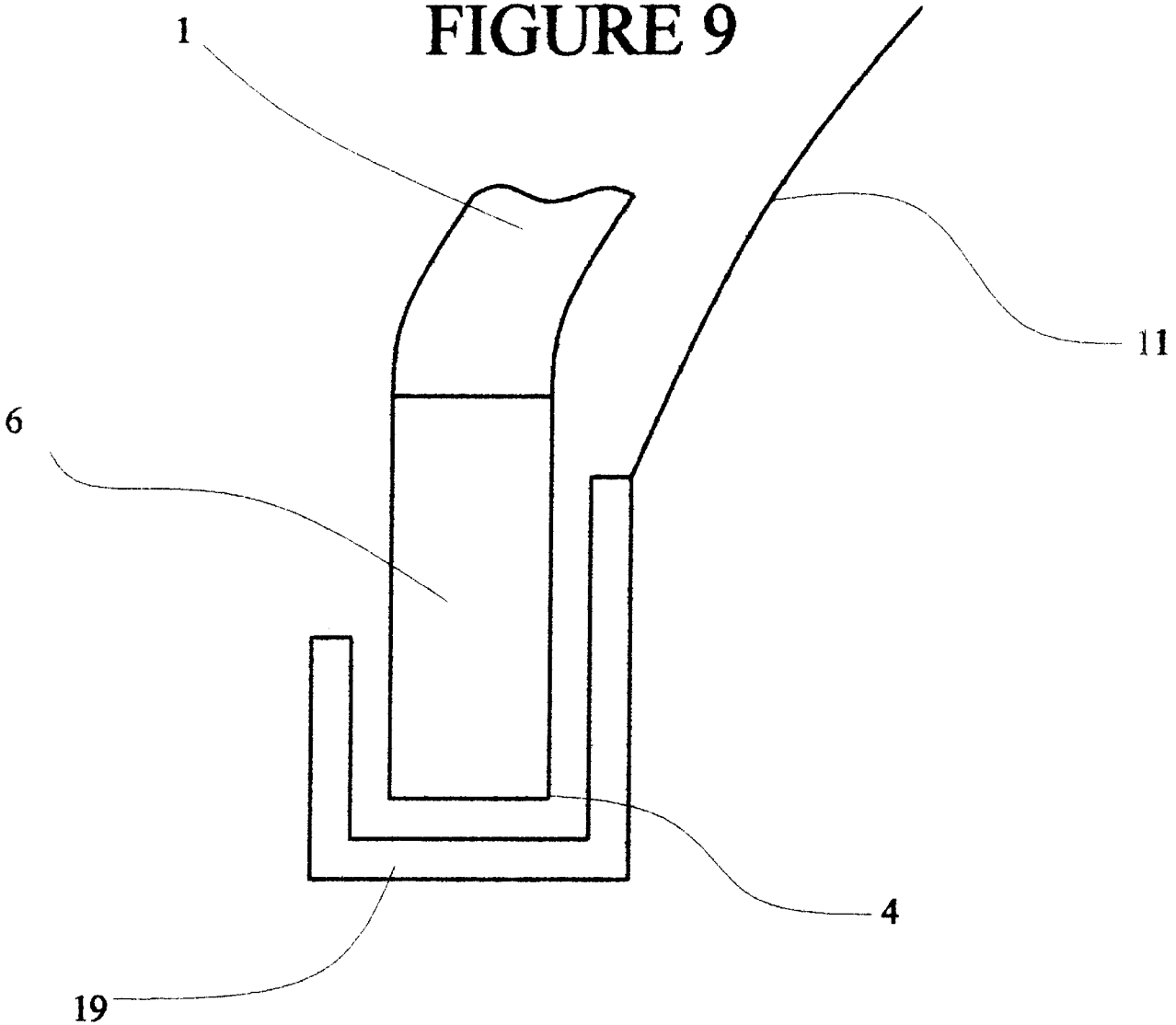
FIG. 9 shows a exploded side view of a hook mechanism and how it is affixed to the inner bead of the recycled tire supporting frame member.

In FIG. 9, a U-typed anchor 19 is shown which simply hangs under the tire bead 6 or inner rim 4. It should be noted that a plurality of other device could be incorporated into affixing the tire supporting member to the surface 14 of a wall 13.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A recycled tire supporting picture frame member for mounting onto a substantially vertical surface, said member comprising:

a) a recycled tire that is turned inside out, said recycled tire having:

i) a substantially round configuration with a substantially round opening in the center thereof;

ii) an essentially untouched inner wall forming an outer surface;

iii) an inner surface directly adjacent an inner rim;

iv) an outer rim and a tire bead having a diameter;

v) an outer perimeter forming an edge of said outer surface having a diameter greater than that of the tire bead;

Wherein said inner surface and said inner rim are sandwiched between said outer rim and said tire bead;

b) at least one anchor affixed to said tire bead;

c) a wire joined to said at least one anchor and adapted to join to said vertical surface;

d) a cavity formed within said round configuration opposite said outer surface; wherein said outer perimeter and said inner rim form respective edges of said cavity;

e) a device affixed within said cavity.

2. The tire supporting picture frame member of claim 1, wherein said device comprises a clock.

3. The tire supporting picture frame member of claim 1, wherein said device comprises a mirror.

4. The tire supporting picture frame member of claim 1, wherein said device comprises a bubble chamber.

5. The tire supporting picture frame member of claim 1, wherein said device comprises a system of shelves.

* * * * *